United States Patent [19]

Schwarzkopf

[11] Patent Number: 4,520,732

[45] Date of Patent: Jun. 4, 1985

[54] AMUSEMENT RIDE

[76] Inventor: Anton Schwarzkopf, Von-Heidenheim-Str. 5, 8909 Münsterhausen, Fed. Rep. of Germany

[21] Appl. No.: 507,898

[22] Filed: Jun. 24, 1983

[30] Foreign Application Priority Data

Feb. 1, 1983 [DE] Fed. Rep. of Germany ..... 3303279

[51] Int. Cl.[3] ..... A63G 21/04

[52] U.S. Cl. ..... 104/53; 104/89; 104/95; 104/245; 105/148; 105/154

[58] Field of Search ..... 104/53, 63, 64, 67, 104/95, 89, 245; 105/154, 148

[56] References Cited

U.S. PATENT DOCUMENTS

| | | | |
|---|---|---|---|
| D. 229,354 | 11/1973 | Morgan | D71/1 R |
| 3,081,711 | 3/1963 | Davino | 104/95 |
| 3,618,686 | 11/1971 | Morsbach | 180/6.7 |
| 3,827,387 | 8/1974 | Morgan | 114/219 |
| 3,865,041 | 2/1975 | Bacon | 104/20 |
| 3,888,185 | 6/1975 | Walsh | 104/89 |
| 3,889,605 | 6/1975 | Bacon | 104/55 |
| 3,908,554 | 9/1975 | Schwarzkopf | 104/53 |
| 3,910,403 | 10/1975 | Morsbach | 198/130 |
| 3,941,060 | 3/1976 | Morsbach | 104/247 |
| 3,972,527 | 8/1976 | Bacon | 272/33 R |
| 4,005,877 | 2/1977 | Humphries | 280/748 |
| 4,032,138 | 6/1977 | Willis | 272/33 R |
| 4,299,171 | 11/1981 | Carson | 104/70 |
| 4,314,512 | 2/1982 | Gerhard | 104/89 |

FOREIGN PATENT DOCUMENTS 2329423 6/1973 Fed. Rep. of Germany .

*Primary Examiner*—Robert R. Song

*Attorney, Agent, or Firm*—Karl F. Ross; Herbert Dubno

[57] ABSTRACT

An amusement ride has an endless path defined by a rail from which the vehicle is suspended by a strut which, at its upper end, is swingable in a deformable frame on a yoke which is likewise pivotal on this frame and carries stirrups by which brackets are pivotally mounted in the carriage. The brackets carry the running and guide rollers. A pair of air springs in the form of bellows cylinders is braced between the strut and the yoke.

20 Claims, 7 Drawing Figures

AMUSEMENT RIDE

FIELD OF THE INVENTION

My present invention relates to an amusement ride and, more particularly, an amusement ride of the type in which the individual or rider is seated in an elongated car which is carried along a path with various loops, turns, dips and rises defined at least in part by a track.

BACKGROUND OF THE INVENTION

It is known to provide amusement rides with a doubly looped, figure-eight or other closed track configuration, from which the car carrying the people can be suspended and even to provide a carriage on such a track from which the car is suspended swingably or floatingly and can rock back and forth relative to the carriage.

The car can carry a number of persons in individual seats or can have benchlike seats one behind the other with each seat carrying two or more people.

Dampers are provided between the car and the track or the rails thereof so as to minimize vibration and to prevent excessive movement from being transmitted to the rider.

In recent years such rides have become increasingly complex as the desire for excitement in the rider has increased and it is thus desirable at relatively low cost, even with simple track configurations, to provide a maximum of enjoyment by generating appropriate movement of the vehicle relative to the carriages and relative to the track. However, this should be done with due consideration to preventing nonenjoyable movements or perturbations and, certainly, without creating danger.

In German patent No. 861,369, for example, a ride is provided with gondolas of aircraft configuration pendulously suspended from the track. This system does not concern itself with problems which arise to the carriages and the track and thus may be satisfactory as far as it goes.

However, in practical realizations of these systems, problems have been encountered precisely at the points where the carriage is mounted on track and where the vehicle is suspended from the carriage.

German open application No. 23 06 385 shows a rider carrier fixed to two upright support arms which are suspended pendulously via running rollers and guide rollers. Here the running rollers are guided in channels which are disposed opposite to one another and are rigidly connected. A ball joint is provided for the arms supporting the rider carrier and means is provided to drive the assembly along a track. Over curved stretches, as a result of centrifugal force, the channels are inclined and lateral forces must be taken up by guide rollers. This system is not equipped to be used for curved tracks which also are inclined.

When the vehicle enters the curve, centrifugal forces are suddenly generated and tend to swing the riders outwardly. The restoring force tends to swing the riders inwardly when the centrifugal force diminishes. The riders and the rider carrier thus swing back and forth past an equilibrium position. When the carrier leaves the curve, such swinging action can continue and resonance can develop to sustain the swinging action or even pose a danger to the rider.

German patent No. 2,329,423 attempts to relieve this problem by providing a rigid vehicle frame in which guide wheels with fixed axes are provided while the running wheels are journaled to the vehicle via a counterweight system.

The track is formed from four tubes forming the rails and these tubes are always horizontally disposed even on curves. Friction dampening elements are used to prevent a build-up of the pendulous oscillations and have a damping characteristic which is proportional to the angular offset from the equilibrium position. This friction damping element can be formed as a telescoping unit pivotally connected between the approximate vertical arm supporting the rider carrier and the vehicle chassis so that it describes a smaller radius than its pivot point on the carrying arm.

The forces effective at the pivot point on the chassis generate a torque on the latter which urges two of the wheels on a side of the vehicle chassis against the rails. The rocking wheels are additionally pressed against at the rails which can effectively brake them.

In practice, therefore, these earlier devices could not fully avoid undesired pendulous movements or stresses upon the ride carrier support and elements connected thereto which can lead to dangerous conditions.

OBJECTS OF THE INVENTION

It is the principal object of the present invention to provide an amusement ride of the type described, namely having a closed-loop track, at least one carriage rolling along this track and a rider carriage suspended pendulously from the track carriage, whereby the disadvantages of the earlier systems described are obviated, stresses can be reduced and undesirable pendulous movements can be eliminated.

Another object of this invention is to provide an amusement ride which extends the principles of German patent No. 2,329,423.

Yet another object of the invention is to provide an arrangement which reduces undesirable pendulous movement of the rider carrier suspended from a closed loop track in an amusement ride.

SUMMARY OF THE INVENTION

These objects and others which will become apparent hereinafter are attained, in accordance with the invention, in an amusement ride which comprises a closed loop track, preferably a double loop or figure-eight configuration formed by a rail system, at least one carriage rollingly displaceable on the rail system, at least one rider carrier suspended from this carriage, and at least one but preferably two swingable arms pendulously connecting the carriage to each carrier at locations spaced therealong in the direction of displacement of the carriage.

According to this invention, running and guide rollers are provided in the carriage and engage the rails of the rail system. The running and guide rollers form groups which are swingably arranged in the carriage to pivot about axes perpendicular to the direction of travel while damping elements are provided in the form of air springs or air dash pots which can be disposed in the form of bellows cylinders between the carrying arm and a yoke of the carriage. The bellows cylinders can be braced between these arms and the yoke.

With this construction, the invention permits the lateral oscillatory movements of the rider carrier to be taken up by air springs in the form of the bellows cylinders and further permits the resulting supporting forces to be transmitted as uniformly as possible to groups of running and guide rollers whose journals define mutually orthogonal or crossing axes of the carriage.

As a consequence, there is a force branching which ensures that portions of the carriage are not overloaded and hence the carriage structure will not be unduly strained.

While in the prior art a portion of the oscillation energy is eliminated by generating friction work, in the system of the invention the damping of the oscillation energy is effected mainly by deformation of the bellows and at the same time by an effect on the restoring force so that smooth and safe travel of the vehicle can be ensured even at high velocities over curves with small radius of curvature and curve paths with rapid curvature direction change.

According to a feature of the invention, the yoke is journaled in a frame about an axis transverse to the direction of travel of the vehicle and the frame itself can be composed of mutually articulated longitudinal and transverse beams. The longitudinal beams can be composed of inwardly open profiles, e.g. channels of U-cross sections.

According to another feature of the invention, each two neighboring running and guide rollers are journaled in a common trestle member (bracket) of angular configuration and this bracket is pivotally supported on a stirrup for movement with respect to an axis transverse to the direction of travel. The stirrup, in turn, is swingable about a vertical axis and is supported in the longitudinal beam of the frame.

According to still another feature of the invention, the vertical axis lies at the crossing between the vertical median plane of the carriage and the longitudinal axis of the stirrup which is directly transverse thereto.

Advantageously, the yoke serves as a journal for a shaft extending in the vertical plane of the carriage and projecting beyond the yoke an opposite sides. Within the yoke, this shaft carries the main pivot for the suspending bar or strut by which the passenger compartment hangs from the carriage. On the two ends of the shaft, vertical pivot axes are defined for journaling the stirrup. One end of the shaft can be flattened and traversed by a pivot pin with a self-aligning bearing which cooperates with the member of the stirrup which engages with play in the shaft end.

The eye of the suspending bar or strut is connected with the shaft via a self-aligning bearing while the yoke itself has a boxlike construction and is provided with a passage for the suspending bar and its eye.

The stirrup can be guided by means of rollers in the longitudinal beam, and the support strut and the yoke can have formations (bosses) extending traversely to the direction of travel between which the bellows cylinders are braced.

According to another aspect of the invention, the amusement ride which can have a figure-eight loop, is formed with an endless rail or track arrangement from which the vehicles are suspended from struts so as to be able to swing from side to side the struts being supported pendulously by a carriage and having their oscillations damped by damping members. According to this aspect of the invention, the rail system comprises a tubular rail including horizontally extending prismatic track members on opposite sides of the rail, and a downwardly projecting guide track against which the guide-running rollers lie. According to the centrifugal force, the orientation of these preferably flat prismatic track members which extend from the rail can be correspondingly inclined.

At the junction of the sections of the track, the rail may be provided with a flange to enable the rail sections to be connected together and to be joined to supports, the prismatic members projecting outwardly from the rail beyond the projection of this flange.

Fishplates or like members may be welded to the prismatic members and the rail, or triangular reinforcement plates may be spaced along the rail and welded to both the rail and the track member so as to stiffen the assembly. The tracks extend outwardly beyond such reinforcements.

It has been found to be advantageous, moreover, to support the rail below an arm which can overhang the rail and on the outside of the vehicle, a downwardly open channel extending in the direction of travel of the vehicle can be provided to receive entraining elements by which the vehicle can be drawn along those portions of the path for which tractive force may be necessary.

It should be apparent that this system provides a relatively versatile construction of the carriage, the rail and track arrangement and the dampening system, greatly simplifying the construction of the amusement ride and providing a more satisfying sensation in the use thereof. The track construction is more stable although of smaller size than earlier track constructions and contributes to a more esthetic appearance for the overall system.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
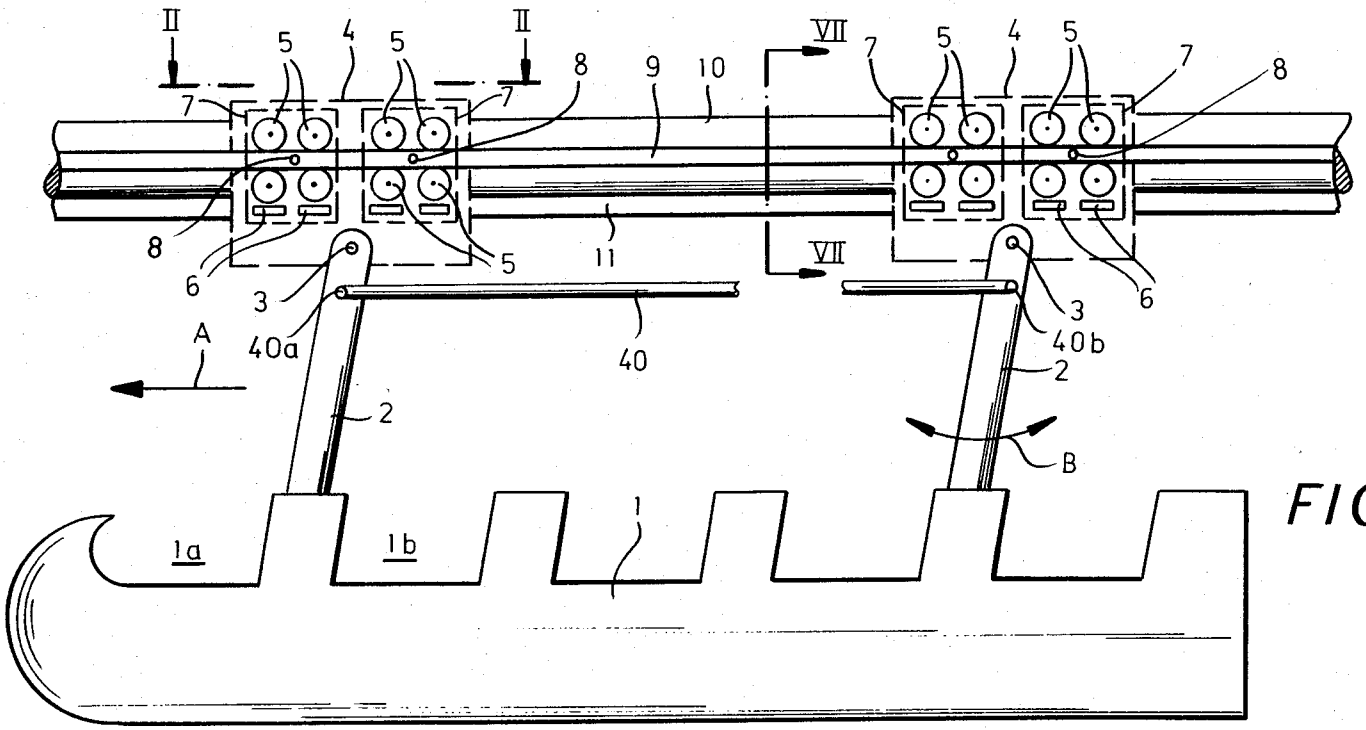
FIG. 1 is a highly diagrammatic side-elevational view of an amusement ride according to the invention and in which a vehicle for riders is suspended on a pair of struts from a pair of carriages which rollingly engage a rail or track structure carrier.
Figure 7:
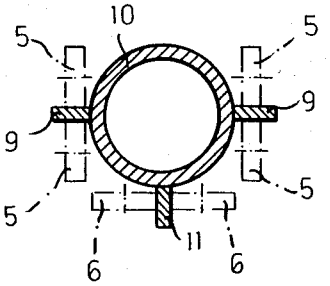
FIG. 7 is a section through the track structure of FIG. 1 taken along the line VII—VII thereof.

In the description of the best mode embodiment of the invention below, it will be apparent that the drawing is highly diagrammatic and may not be to scale in some portions. Thus, details of the shafts on which the rollers are journaled, fastening members, journal bearings and the like, which would be self-understood by the ordinary skilled worker in the art, have been omitted. In addition, the suspending strut has been shown with a plain configuration whereas in general it has a streamlined cross section tapering rearwardly; other details which contribute to the esthetics of the amusement ride have also been omitted so as not to obscure those concepts which are essential to the present invention.

Thus in FIG. 1, I have shown highly schematically a vehicle 1 which can seat at least five persons (hereinafter "riders") and if in appropriate width can seat two or more riders at each of the stations 1*a*, 1*b*, etc. of this vehicle.

The vehicle has fixed thereto a pair of suspending struts 2 which are shown to be inclined somewhat rearwardly, the direction of travel being represented in FIG. 1 by the arm A. Each of these struts 2 is pendulously supported at a respective horizontal pivot 3 on a respective carriage 4, the carriages being spaced apart parallel to the direction of arrow A.

The carriages ride on a track structure 9, 10, 11 which forms part of a closed-path track which can have the configuration of a figure-eight or any other closed pattern designed to provide a number of curves, turns and direction changes. Naturally, there can be upward and downward slides, dips and straight or horizontal sections which can follow one another in close succession in combination with curves which change direction rapidly so as to provide high velocity stretches followed by slow stretches and vice versa, all with the aim of affording the rider a most satisfying and exciting ride.

Since each of the struts 2 is swingably suspended from a main pivot 3 from a respective carriage 4, the two struts may be interconnected by a common bar 40 which is articulated at 40*a* and 40*b* to the two struts so as to allow the vehicle to swing on the two pivots 3 back and forth slightly as represented by the arrows B.

Figure 3:
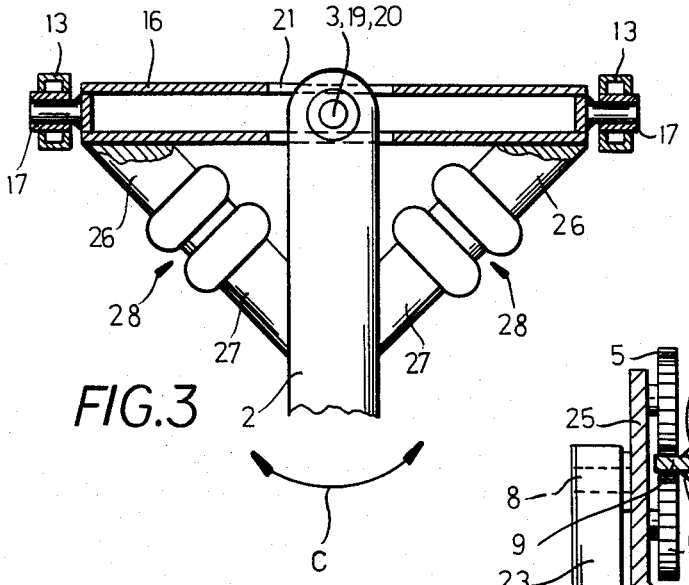
FIG. 3 is a partial section along the line III—III of FIG. 2.

As the carriages pass around a curved section of the track, significant centrifugal force can be generated which tends to swing the vehicle 1 outwardly and hence to swing the strut 2 in one or another of the directions represented by the double-headed arrow C in FIG. 3. An oscillation in this sense can be developed which is damped as will be described in greater detail below.

Each of the carriages 4 is provided with a number of supporting and guide roller assemblies 7 and in the embodiment shown, two such assemblies 7 have been illustrated for each carriage.

Each of the assemblies 7 comprises four pairs of running rollers 5 and two pairs of guide rollers 6. The running rollers include one roller of each pair which carries the weight of the vehicle and another roller of the same pair opposed to the first so that the two rollers of each pair pinch a portion of the track between them. Each pair of rollers thus engages on opposite sides of a track portion 9 or 11 of rectangular cross section and welded to the tubular rail 10. On curved structures these track portions 9 and 11 are inclined to correspond to the centrifugal force application and permit tilt of the vehicle to the corresponding side. The tubular member 10, of course, has its axis following the theoretical track axis and is correspondingly curved to define the curved stretches.

According to the invention, the forces assisting the pendulous movement of the struts 2 and generated by damping these oscillations are distributed uniformly to the rollers 5 and 6 to avoid overstressing any part of the carriage. To this end, each of the roller assemblies 7 is pivotally suspended in the carriage 4 utilizing a pivot arrangement whose axis has been represented at 8 in FIG. 1. This pivot axis extends transversely to the direction of displacement A of the vehicle and has been shown only symbolically since it runs perpendicular to the plane of the paper in FIG. 1. Further details of this pivot will be apparent from FIG. 2.

Figure 2:
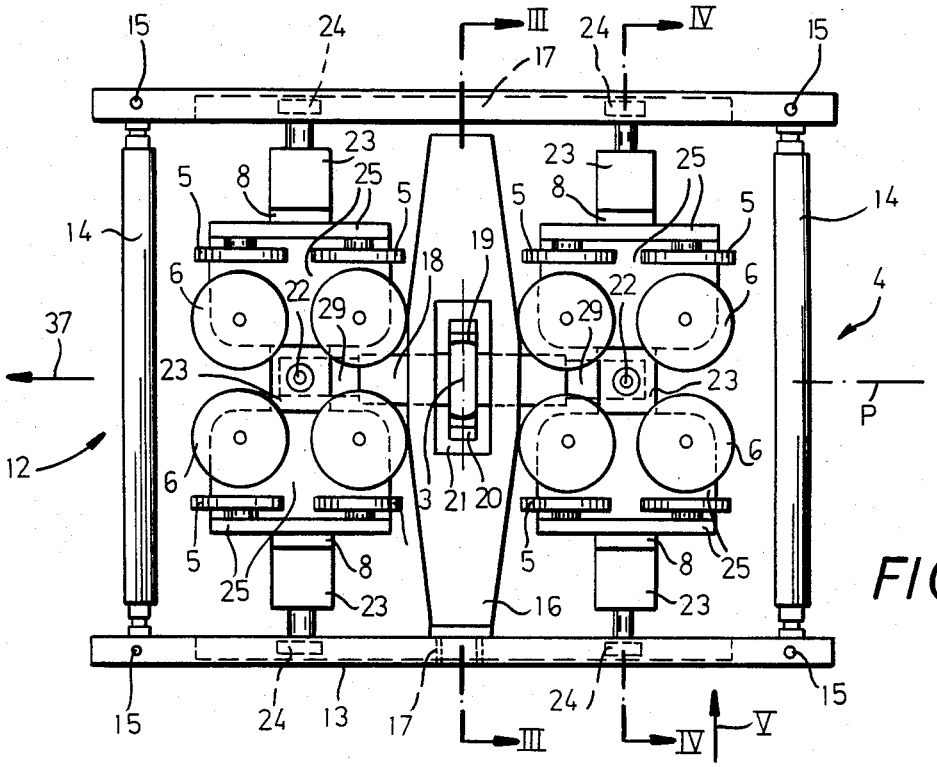
FIG. 2 is a plan view taken generally along the line II—II of FIG. 1 but to a significantly larger scale.

The carriage 4 shown in FIG. 2 comprises basically a frame 12 formed from longitudinal beams 13 straddling the rail and transverse beams 14 connected at opposite ends to the longitudinal beams by pivots 15. The pivotal connections at the four corners of this frame are designed to permit forces which are applied to the frame to distort the latter from the rectangular orientation shown into some other parallelogrammatic configuration.

In the middle of carriage 4, I provide a yoke 16 which is formed as a hollow box-like structure which is pivotally connected at its ends by bearings 17 with the longitudinal beams 13. These bearings, which can be formed as slide bearings preferably allow a certain amount of axial play so that the aforementioned distortion of the pivotally jointed frame does not cause detrimental stresses to arise where this track is joined to the frame.

The yoke 16 is traversed by a shaft 18 which is journaled in this yoke for rotation about a longitudinal axis lying in the vertical median plane P of the carriage and extending in the direction of displacement of the carriage represented at 37 in FIG. 2.

This direction corresponds to the direction A shown in FIG. 1.

The ends of the shaft 18 are provided with flattened stubs 29 in which pivots 22 with vertical pivot axes are provided. The function of the pivots 22 will be developed below with respect to FIG. 4.

Within the box-shaped yoke 16, on the shaft 18, I provide a self-aligning bearing 19 to receive the eye 20 of the strut 2 and thus the main pivot 3 (compare FIG. 1). To allow a certain degree of mobility of the eye 20 or the strut 2, the upper and lower wall of the yoke 16 are provided with correspondingly enlarged windows 21 (see FIG. 2). The struts 2 can thus swing about the axis defined by the shaft 18 transverse to the direction 37 of travel.

Figure 4:
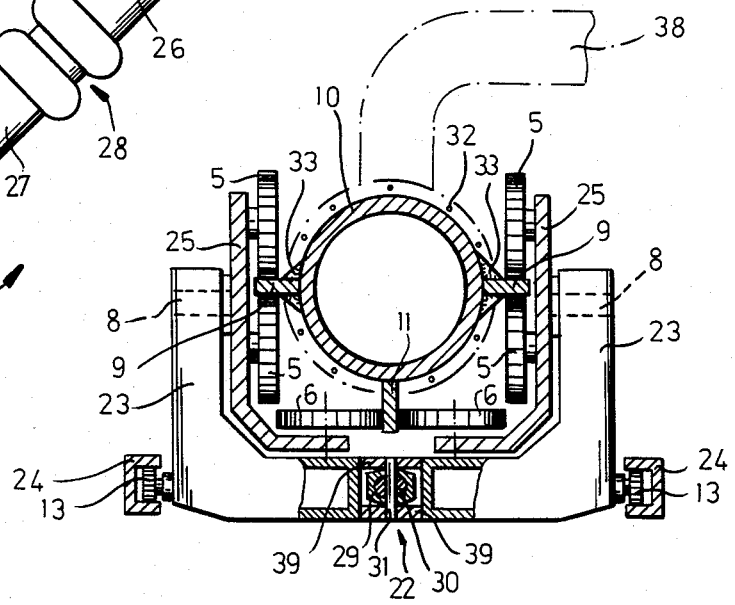
FIG. 4 is a section taken generally along the line IV—IV of FIG. 2, a support arm for the rail and track assembly being shown highly diagrammatically.

The angular oscillation thus generated is damped by the system shown in greater detail in FIG. 3 with the resultant forces applied to the track 16 in the form of torque about the axis of rotation of the shaft 18. As has already been seen from FIG. 1, groups of running rollers 5 and guide rollers 6 are coupled together and pivotally suspended in the carriage 4 from the frame 14. As can be seen from FIG. 2, the rollers 5, 6 of each set are journaled in a common angle bracket 25 (see also FIG. 4) which in turn is pivotal about the aforementioned axis 8 on a stirrup 23 so that each stirrup carries two roller groups in a U-configuration as is also shown in FIG. 4. The stirrup 23, in turn, is pivotally mounted at 22 on the stub 29 of the shaft at 8. Rollers 24 ride in tracks formed by the longitudinal beams 13 so that relative movement of the stirrup and the frame is permitted as the stirrup pivots at 22.

As the carriage 4 enters a curved stretch of track, the stirrup 23 will rotate about the vertical axis of pivot 22, thereby changing the angle between the stirrup and the frame, a motion which is not impeded because of the movement of the rollers 24 in the longitudinal beams 13. The latter are formed as inwardly open channels (U-profiles) to constitute rails to receive these rollers.

The pivots 22 are also in the form of self-aligning bearings 30 (FIG. 4) which allow swinging movement, so that the stirrup 23 can automatically adjust itself as the vehicle passes the inflection point. The rotary journaling of the shaft 18 in the yoke 16 provides a further degree of freedom which permits the track to be tilted in the region of the inflection points without applying stresses to the rollers 5 and 6 or their bearings.

In an extreme case, the articulated frame 12 can distort at the pivots as well.

In FIG. 3, the yoke 16 has been shown in section. It will be apparent that both the strut 2 and the yoke 16 have bosses 26 and 27 which extend toward one another and between which bellows cylinders 28 forming air cushions are provided. These air springs 28 are conventional air springs as have been used heretofore in the suspensions of heavy trucks and railway vehicles.

The angular oscillations about the axis defined at 3, 19, 20, deform the air springs 28 and by compressing one and extending another, the compressed air spring generates a restoring force. The air springs can be provided with valves which can be connected to a compressed air source to generate a predetermined air pressure within the springs 28 and to maintain this pressure.

The number of air springs and their pressurization should be selected to generate the necessary restoring force and damping action. If a restoring force is to be completely eliminated, the spaces within the two opposing air springs can be connected by a fluid-communicating conduit.

The damping of the oscillation of the strut 2 by the air springs 28 generates a torque on the yoke 16 about the axis 3. This torque is transmitted via the bearing 17 to the longitudinal beams 13 of the frame 12 and because of the pivotal mounting of the roller groups 7, uniformly to the rollers of these groups.

Since the rollers 5 and 6 bear over their full width on the tracks 9 and 11, the forces are uniformly distributed and breakage can be avoided.

As can be seen from FIG. 4, the shaft 18 has its flattened portions 29 located between a pair of spaced-apart webs 39 of the stirrup 23. A pivot pin 31 is fixed in these webs 39 and carries a ball 30 forming a self-aligning bearing on which is engaged the pin 31 located between the webs 39 and forming the pivot for the stirrup 23.

The shaft 18 is thus able to angularly move about its axis in spite of the attachment to the stirrup illustrated. The other stirrup need not have such a self-aligning bearing.

FIG. 4 also illustrates the running and guide tracks 9 and 11 of the rail 10 which is a tube, these tracks being stiffened in their junction to the rail by fillet plates 33, the rails, plates and tracks being welded together.

The running surfaces for the rolls 5 and 6 are disposed, of course, outwardly of the reinforcing plates 33.

Many rail sections can be connected together by flanges 32 which can have a diameter such that the running surfaces of the rails 9 and 11 are unaffected (see the dot-dash lines in FIG. 4). In other words, the tracks project outwardly beyond the flanges as well. The tracks can be suspended on arms 38, which can be bolted to the flanges also without adversely affecting the movment of the rolls 5 and 6. In the side view of FIG. 5, the pivot 8 for the sets of rollers are shown in greater detail, the angle brackets 25 being pivotable therearound.

Figure 5:
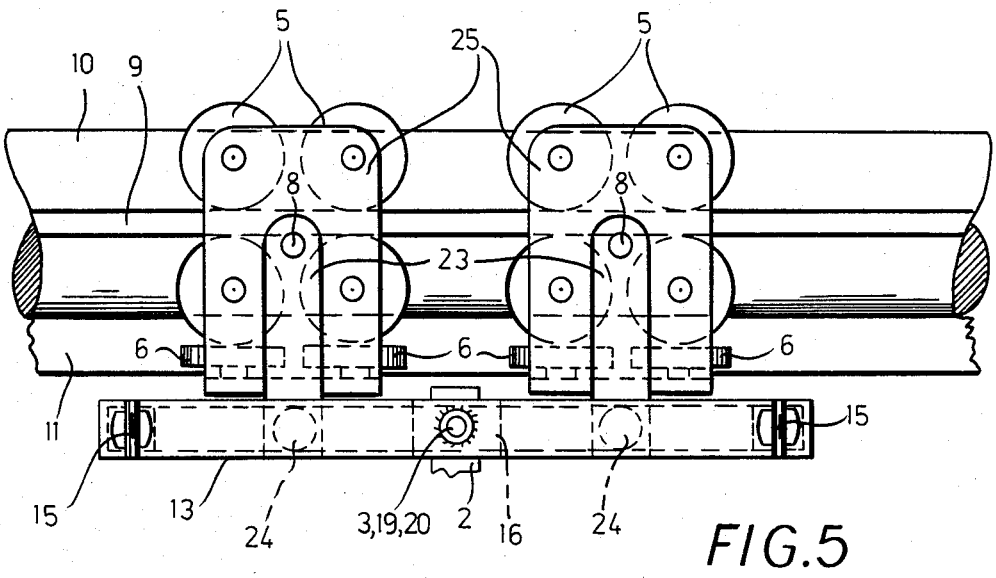
FIG. 5 is a fragmentary side elevational view in line of the carriages taken in the direction of the arrow V in FIG. 2.

While the tracks 9 have been illustrated in FIG. 5 as having flattened surfaces, the tracks can also have concave or convex surfaces, in which case the rolls 5 and 6 can have complementary curvature to form-fittingly engage the tracks.

Figure 6:
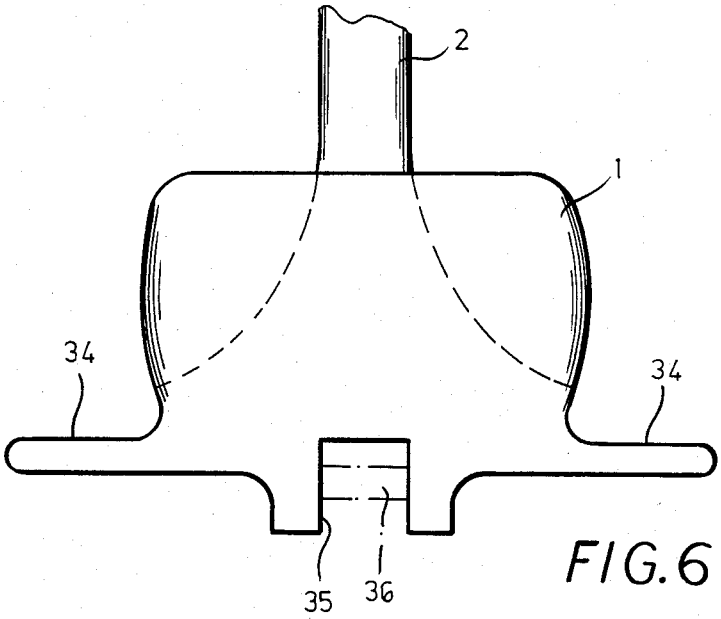
FIG. 6 is an end view of the vehicle of FIG. 1.

From FIG. 6 it should also be clear that the individual vehicles 1 on their undersides have a channel 35 which is open downwardly and extends in the direction of travel and which is internally provided, as shown diagrammatically by dot-dash lines, with entraining means 36 which enable engagement by a tractive element for propelling the vehicle over at least a portion of the path. In the usual way, the tractive element, e.g. a chain, can carry the vehicle to the high point of the path and the vehicle can be released to travel freely over the remaining dips, rises and turns using the potential energy thus delivered. This also differs from conventional systems which generally drive the carriage above the suspended vehicle.

Since the carriage is highly flexible, its distance from the vehicle can be considerable and any braking device can likewise be considerably removed from the carriage. At 34 running boards have been illustrated to assist the rider in stepping into the vehicle.

I claim:

1. An amusement ride comprising:

rail means defining a closed travel path;

at least one carriage provided with running rollers and guide rollers riding on said rail means;

at least one strut extending downwardly from said carriage swingably mounted thereon for pendulous movement relative to said carriage;

a vehicle fixed to said strut below said carriage whereby said vehicle is suspended from said strut, said carriage comprising a frame, a yoke spanning said frame in a direction transverse to the direction of travel of said vehicle along said path, and means for suspending said strut from said yoke; and at least one pair of air springs in the form of bellows cylinders braced between opposite sides of said strut and said yoke for damping angular oscillations of said strut.

2. The amusement ride defined in claim 1, further comprising means for journaling said yoke on said frame for pivotal movement about an axis transverse to said direction of travel.

3. The amusement ride defined in claim 1 wherein said frame comprises a pair of longitudinal members, a pair of transverse members and articulations between said longitudinal and transverse members enabling deformation of said frame.

4. The amusement ride defined in claim 3 wherein said longitudinal members are inwardly open U-section channels, said yoke being provided with a shaft extending generally in said direction, a stirrup swingably mounted on said shaft and carrying said rollers, and a further pair of rollers on said stirrup riding in said channels.

5. The amusement ride defined in claim 1 wherein said running rollers and guide rollers are provided in pairs for engagement with opposite sides of respective tracks of said rail means, an angle bracket being provided for at least one pair of running rollers, and at least one pair of guide rollers, a stirrup being mounted on said frame for pivotal movement about at least one vertical axis, said bracket being pivotally mounted on said stirrup at a horizontal axis.

6. The amusement ride defined in claim 5 wherein said vertical axis is disposed at the intersection of a horizontal axis pivotally mounting said stirrup on said frame with the longitudinal median plane through said passage.

7. The amusement ride defined in claim 1, further comprising a shaft mounted on said yoke and extending in said direction, sad shaft projecting from said yoke on opposite sides thereof and forming a pivot for an eye of said strut.

8. The amusement ride defined in claim 7, further comprising a self-aligning bearing carried by an end of said shaft, a stirrup mounted on said bearing at said end of said shaft, and respective angle brackets pivotally mounted on said stirrup and carrying said rollers.

9. The amusement ride defined in claim 7, further comprising a self-aligning bearing between said eye of said strut and said shaft, said yoke having a box-like construction with upper and lower walls formed with windows accommodating swinging movement of said strut and said eye.

10. The amusement ride defined in claim 8 wherein said stirrup is provided with rollers riding on said carriage.

11. The amusement ride defined in claim 1 wherein said yoke and said strut are provided with bosses reaching toward one another, each of the bellows cylinders being braced between one such boss of said strut and another such boss of said yoke.

12. The amusement ride defined in claim 1 wherein said rail means comprises a tubular rail, a pair of prismatic tracks projecting laterally from said rail and engaged by said running rollers.

13. The amusement ride defined in claim 12 wherein said rollers are inclined over curved stretches of said path corresponding to the centrifugal force generated by said curved portion of said path.

14. The amusement ride defined in claim 12 wherein said rail is provided with an annular flange for connecting said rail to another similar rail thereby forming said rail means from rail sections, said tracks extending outwardly beyond the outline of said flanges.

15. The amusement ride defined in claim 12, further comprising stiffening plates welded between said rail and said tracks, said tracks lying outwardly beyond said stiffening plates.

16. The amusement ride defined in claim 12, further comprising a suspending arm engaging said rail from above.

17. The amusement ride defined in claim 1 wherein said vehicle is provided with a downwardly open channel having at least one formation engageable with tractive means for displacing said vehicle over at least a portion of the path.

18. An amusement ride comprising:

rail means forming a closed travel path, said rail means being formed with a tubular rail, a pair of lateral prismatic tracks welded to said rail and a vertical track welded to said rail;

at least one carriage provided with two pairs of running rollers engaging said lateral tracks between them, and at least one pair of guide rollers engaging said vertical track between them, said carriage riding on said rail means along said path;

at least one strut pendulously supported at an upper end on said carriage; and at least one vehicle mounted on said strut.

19. The amusement ride defined in claim 18 wherein: said carriage comprises a deformable frame having longitudinal and transverse members articulated to one another at corners of said frame, said longitudinal members being formed as inwardly open channels, a yoke extending across said frame and pivotally connected to said longitudinal members for rotation about an axis transverse to the direction of displacement of said vehicle, a shaft mounted in said yoke for angular displacement about an axis parallel to said direction, a self-aligning bearing mounting an eye of said strut swingably on said shaft within said yoke, said shaft having opposite ends projecting from said yoke, a stirrup pivotally mounted on each end of said shaft, respective pairs of angle brackets pivotally mounted in each of said stirrups, each angle bracket comprising at least one pair of running rollers engaging one of said lateral tracks and at least one pair of guide rollers engaging said vertical track, and respective rollers riding in said channels and carried by said stirrup; and respective air springs are provided between opposite sides of said strut and said yoke.

20. The amusement ride defined in claim 19 wherein said vehicle is formed with a downwardly open channel extending in said direction and provided with a formation engageable with tractive means for displacing said vehicle.

* * * * *